US012050047B2

(12) United States Patent
Mezavila et al.

(10) Patent No.: US 12,050,047 B2
(45) Date of Patent: Jul. 30, 2024

(54) DOOR-MOUNTED BIN ASSEMBLY

(71) Applicant: WHIRLPOOL CORPORATION, Benton Harbor, MI (US)

(72) Inventors: Moacyr Marangone Mezavila, St. Joseph, MI (US); Kevin Y. Zhang, St. Joseph, MI (US); Akshit Anil Markan, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 243 days.

(21) Appl. No.: 17/490,538

(22) Filed: Sep. 30, 2021

(65) Prior Publication Data

US 2022/0128293 A1 Apr. 28, 2022

Related U.S. Application Data

(60) Provisional application No. 63/104,091, filed on Oct. 22, 2020.

(51) Int. Cl.

| | |
|---|---|
| ***F25D 23/04*** | (2006.01) |
| ***F25C 5/182*** | (2018.01) |
| ***F25D 17/06*** | (2006.01) |
| ***F25D 23/02*** | (2006.01) |
| ***F25D 23/06*** | (2006.01) |

(52) U.S. Cl.

CPC ..... *F25D 23/04* (2013.01); *F25C 5/182* (2013.01); *F25D 17/062* (2013.01); *F25D 23/028* (2013.01); *F25D 23/066* (2013.01); *F25C 2400/10* (2013.01)

(58) Field of Classification Search

CPC ..... F25C 5/182; F25D 17/062; F25D 23/028; F25D 23/066

See application file for complete search history.

(56) References Cited

U.S. PATENT DOCUMENTS

| | | | | |
|---|---|---|---|---|
| 7,596,964 | B2 | 10/2009 | Lim et al. | |
| 7,775,065 | B2 | 8/2010 | Ouseph et al. | |
| 7,856,832 | B2 | 12/2010 | Lim et al. | |
| 9,109,819 | B2 | 8/2015 | Shin et al. | |
| 10,119,747 | B2 | 11/2018 | You et al. | |
| 2007/0113578 | A1* | 5/2007 | Wu | F25C 5/182 62/344 |
| 2012/0167611 | A1* | 7/2012 | Weirich | F25D 23/04 62/344 |
| 2018/0066884 | A1 | 3/2018 | Quinlan et al. | |
| 2019/0204002 | A1 | 7/2019 | Avhale et al. | |

* cited by examiner

*Primary Examiner* — Elizabeth J Martin
(74) *Attorney, Agent, or Firm* — Price Heneveld LLP

(57) ABSTRACT

An appliance door for a refrigerator appliance includes a liner that defines an icemaker receiving space and a bin receiving space. The icemaker receiving space is at least partially defined by a central portion of the liner and the bin receiving space is at least partially defined by the central portion and opposing sidewalls of the liner. An icemaker assembly is positioned within the icemaker receiving space and above the central portion. A bin is positioned in the bin receiving space and below the central portion. The bin includes a cover portion that extends upward from a storage portion. The storage portion is rotatably coupled with the opposing sidewalls of the liner. A plate is positioned within a central cavity defined by the central portion of the liner. The plate is configured to cool the bin receiving space.

19 Claims, 7 Drawing Sheets

DOOR-MOUNTED BIN ASSEMBLY

CROSS-REFERENCE TO RELATED APPLICATION

This application claims priority to and the benefit under 35 U.S.C. § 119(e) of U.S. Provisional Application No. 63/104,091, filed on Oct. 22, 2020, entitled "DOOR-MOUNTED BIN ASSEMBLY," the disclosure of which is hereby incorporated herein by reference in its entirety.

BACKGROUND OF THE DISCLOSURE

The present disclosure generally relates to a bin assembly, and more specifically, to a door-mounted bin assembly.

SUMMARY OF THE DISCLOSURE

According to one aspect of the present disclosure, an appliance door for a refrigerator appliance includes a liner that defines an icemaker receiving space and a bin receiving space. The icemaker receiving space is at least partially defined by a central portion of the liner and the bin receiving space is at least partially defined by the central portion and opposing sidewalls of the liner. An icemaker assembly is positioned within the icemaker receiving space and above the central portion. A bin is positioned in the bin receiving space and below the central portion. The bin includes a cover portion that extends upward from a storage portion. The storage portion is rotatably coupled with the opposing sidewalls of the liner. A plate is positioned within a central cavity defined by the central portion of the liner. The plate is configured to cool the bin receiving space.

According to another aspect of the present disclosure, a refrigerator appliance includes a cabinet that defines a compartment. A door is hingedly coupled with the cabinet and configured to selectively seal the cabinet. The door includes a liner and an icemaker assembly. A duct is coupled with the icemaker assembly and is configured to provide chilled air to the icemaker assembly. A bin is positioned below the icemaker assembly. The bin is configured to maintain a temperature below the temperature of the compartment and above freezing According to yet another aspect of the present disclosure, a method of cooling a bin coupled with an appliance door includes a step where an icemaker assembly is positioned within an upper portion of the appliance door. Next, the bin is positioned within a bin receiving space defined by a liner of the appliance door and separated from the icemaker assembly by a central portion of the liner. Chilled air is provided to the icemaker assembly to maintain at least a portion of the icemaker assembly at a temperature below freezing. The bin receiving space is cooled by natural convection through the central portion of the liner between the icemaker assembly and the bin receiving space such that the bin is maintained at a temperature above freezing and below a temperature of a refrigeration compartment of the appliance.

These and other features, advantages, and objects of the present disclosure will be further understood and appreciated by those skilled in the art by reference to the following specification, claims, and appended drawings.

Figure 1:
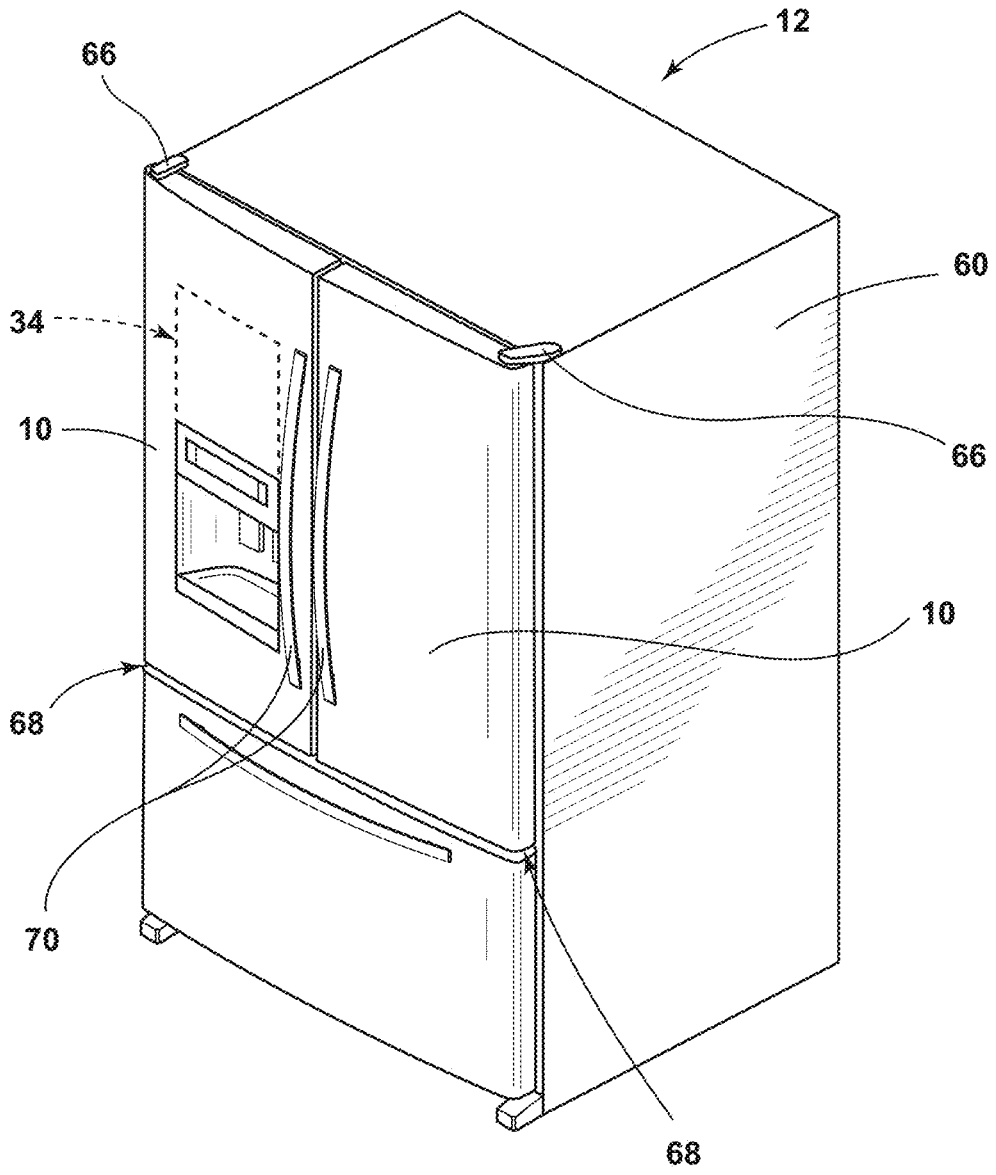
FIG. 1 is a side perspective view of a refrigerator appliance with a refrigerator door in a closed position.

The components in the figures are not necessarily to scale, emphasis instead being placed upon illustrating the principles described herein.

DETAILED DESCRIPTION

The present illustrated embodiments reside primarily in combinations of method steps and apparatus components related to a door-mounted bin assembly configured to house beverages. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-6, reference numeral 10 generally designates a door for a refrigerator appliance 12. The refrigerator door 10 includes a liner 16 defining an icemaker receiving space 20 and a bin receiving space 22. The icemaker receiving space 20 is at least partially defined by a central portion 26 of the liner 16, and the bin receiving space 22 is at least partially defined by the central portion 26 and opposing sidewalls 28, 30 of the liner 16. An icemaker assembly 34 is positioned within the icemaker receiving space 20 above the central portion 26. A bin 38 is positioned in the bin receiving space 22 below the central portion 26. The bin 38 includes a cover portion 40 extending upward from a storage portion 42. The storage portion 42 is rotatably coupled with the opposing sidewalls 28, 30 of the liner 16. A plate 48 is positioned within a central cavity 46 defined by the central portion 26 of the liner 16. The plate 48 is configured to transmit cooling from the icemaker receiving space 20 to the bin receiving space 22.

Figure 2:
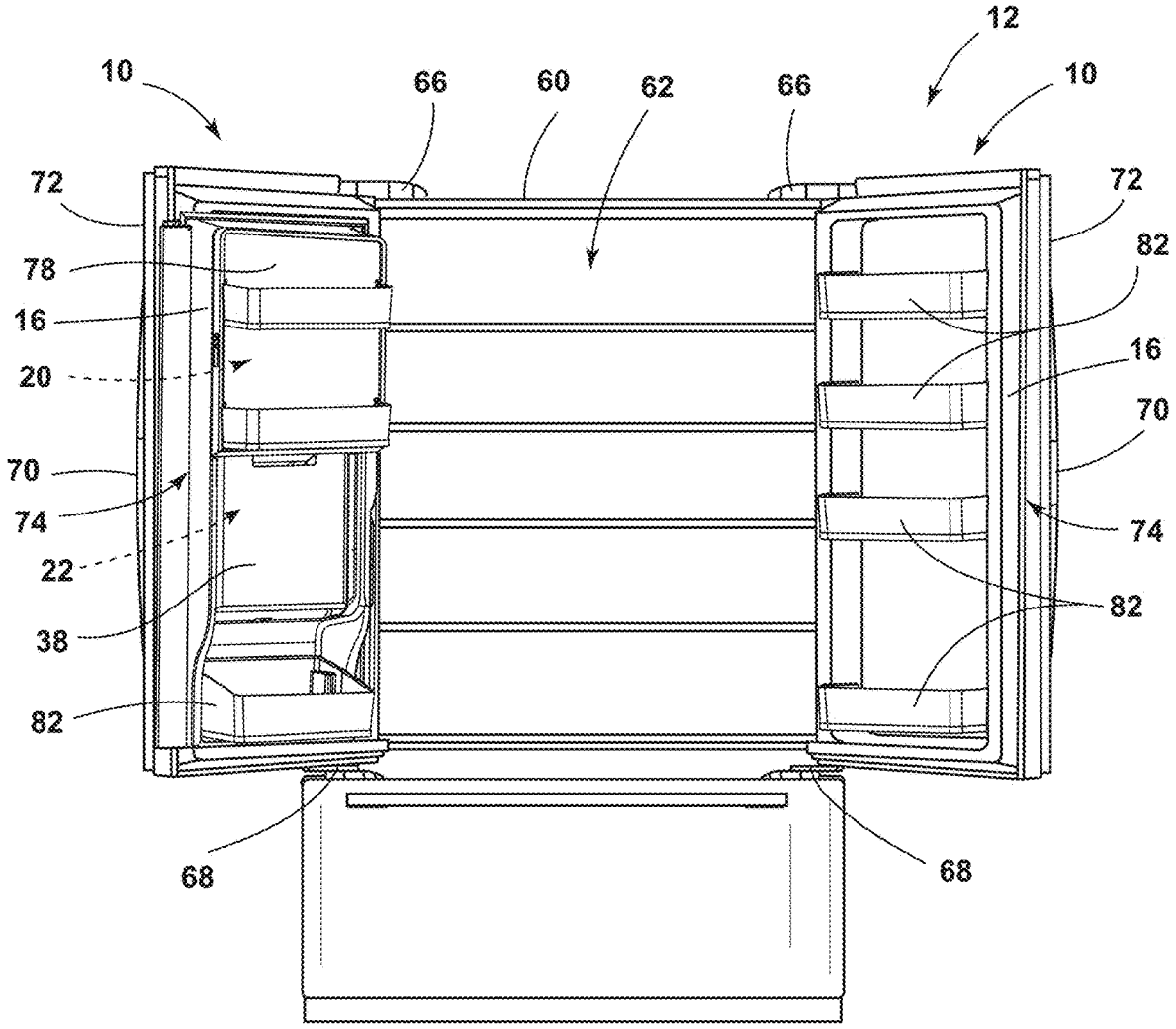
FIG. 2 is a front elevational view of the refrigerator appliance of FIG. 1 with the refrigerator door in an open position.

Referring now to FIGS. 1 and 2, the refrigerator appliance 12 includes a cabinet 60 defining a compartment 62. The compartment 62 may be configured as a refrigeration compartment and may be configured to refrigerate consumables and may accordingly be kept at a temperature above the freezing point of water and generally below a temperature of from about 35° F. to about 50° F., more typically below about 38° F.

A refrigerator door 10 is hingedly coupled with the cabinet 60 by upper and lower hinge assemblies 66, 68. As illustrated, the refrigerator door 10 may be one of a pair of refrigerator doors 10 hingedly coupled to opposing sides of the cabinet 60 and configured to selectively seal the compartment 62. Each refrigerator door 10 may include a handle 70 for opening and closing the refrigerator door 10. While the illustrated figures generally show a refrigerator appliance 12 of the French-door bottom mount type, but it is understood that this disclosure could apply to any type of refrigerator, such as a side-by-side, two-door bottom mount, or a top-mount type refrigeration unit.

Referring still to FIG. 2, the refrigerator appliance 12 is shown with the refrigerator doors 10 in an open position. Each of the refrigerator doors 10 includes a liner 16 coupled with an outer panel 72 of the refrigerator door 10. The liner 16 forms an inner surface of the respective refrigerator door 10 and is spaced apart from the outer panel 72 to define an inner cavity 74 therebetween. It will be understood that any one of the refrigerator doors 10 may include sealing gaskets, flanges, or any other feature configured to contact the cabinet 60 to seal the compartment 62 when the refrigerator door 10 is closed. One or both of the refrigerator doors 10 may further include door bins 82 coupled with the liner 16. The door bins 82 may be configured to be removable and/or adjustable.

Figure 3:
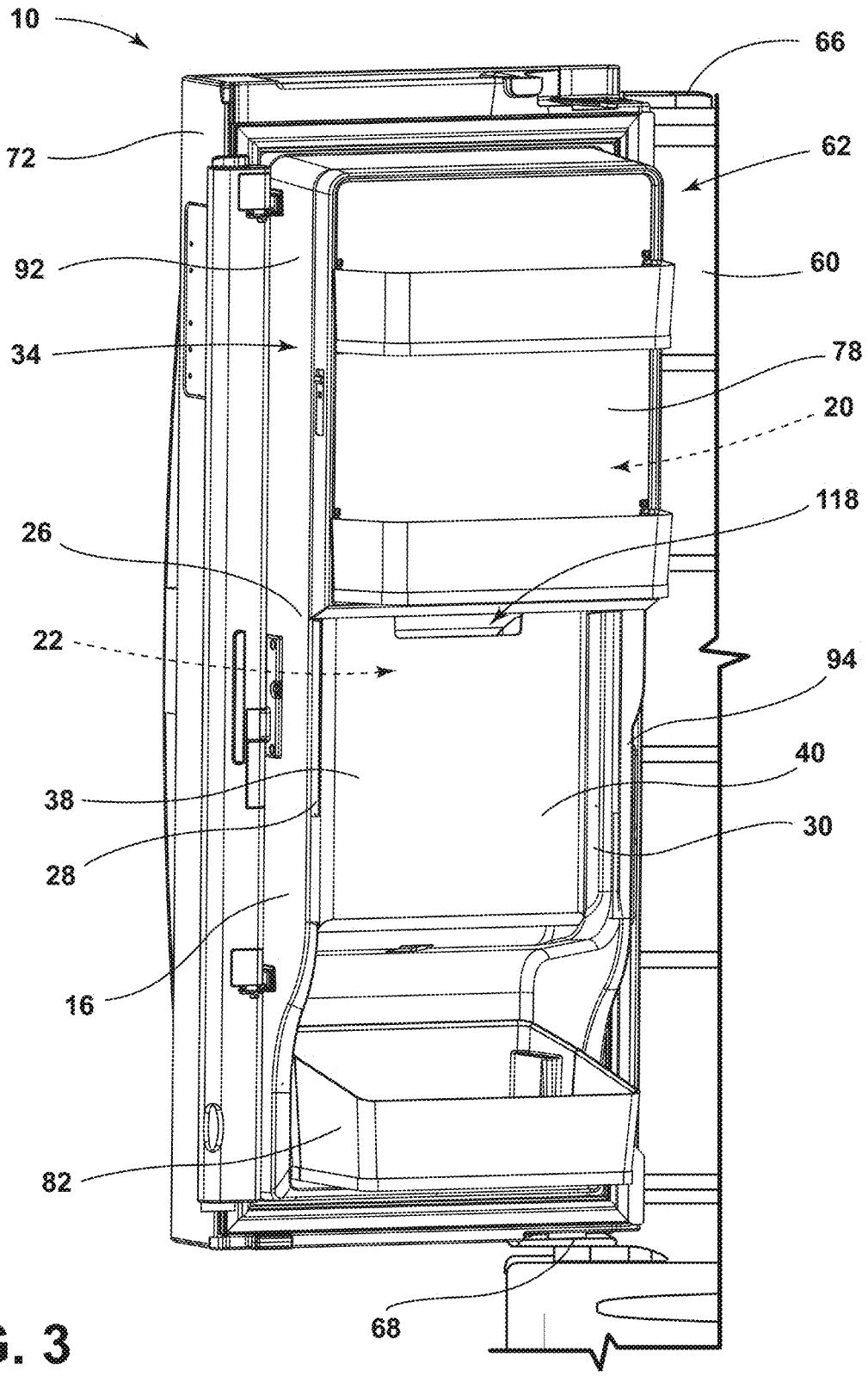
FIG. 3 is an enlarged front perspective view of one of the refrigerator doors of FIG. 2.

As illustrated in FIGS. 1-3, at least one of the refrigerator doors 10 includes an icemaker assembly 34 mounted at an upper portion of the refrigerator door 10. As previously introduced, the liner 16 of the refrigerator door 10 defines the icemaker receiving space 20 and the bin receiving space 22. As illustrated, the icemaker receiving space 20 is defined by the liner 16 proximate the upper portion of the refrigerator door 10, and the icemaker assembly 34 is at least partially positioned within the icemaker receiving space 20. The icemaker receiving space 20 may be in communication with the inner cavity 74 of the refrigerator door 10 or may be separated from the inner cavity 74 by the liner 16.

The icemaker assembly 34 may be configured to provide an ice-making process that may be induced, carried out, stopped, and the ice harvested with little, or no, user input. In various examples, the icemaker assembly 34 may include an icemaker door 78 configured to selectively seal the icemaker assembly 34. It is further contemplated that the icemaker assembly 34 may include components typically found in an icemaker, such as an ice cube tray, an icebox, a fluid dispenser, a motor, and the like. Such components will not be described further herein except where necessary for a complete understanding of the aspects of the present disclosure.

Figure 4:
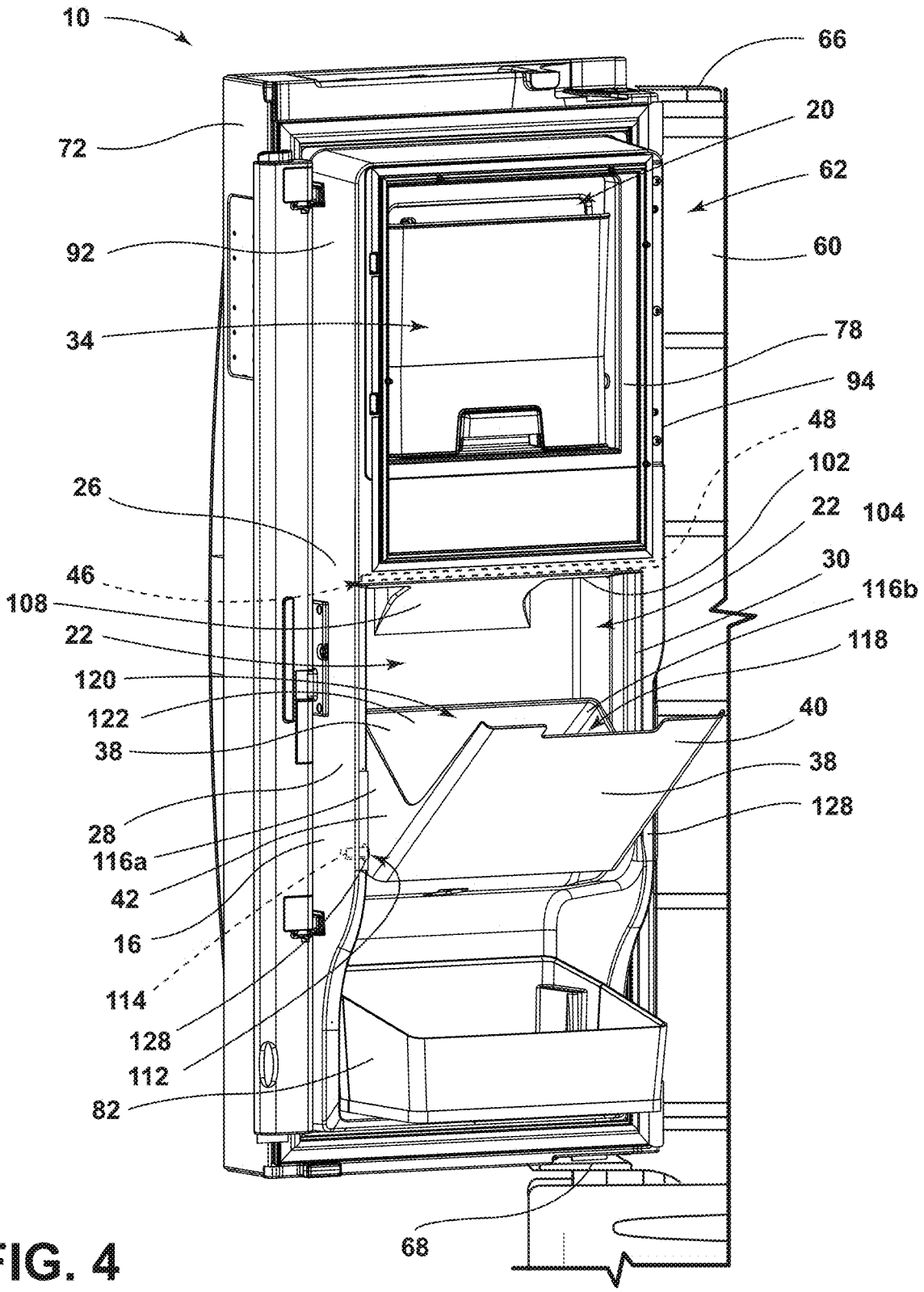
FIG. 4 is a front perspective view of the refrigerator door of FIG. 3 with the bin assembly in a second position.
Figure 5:
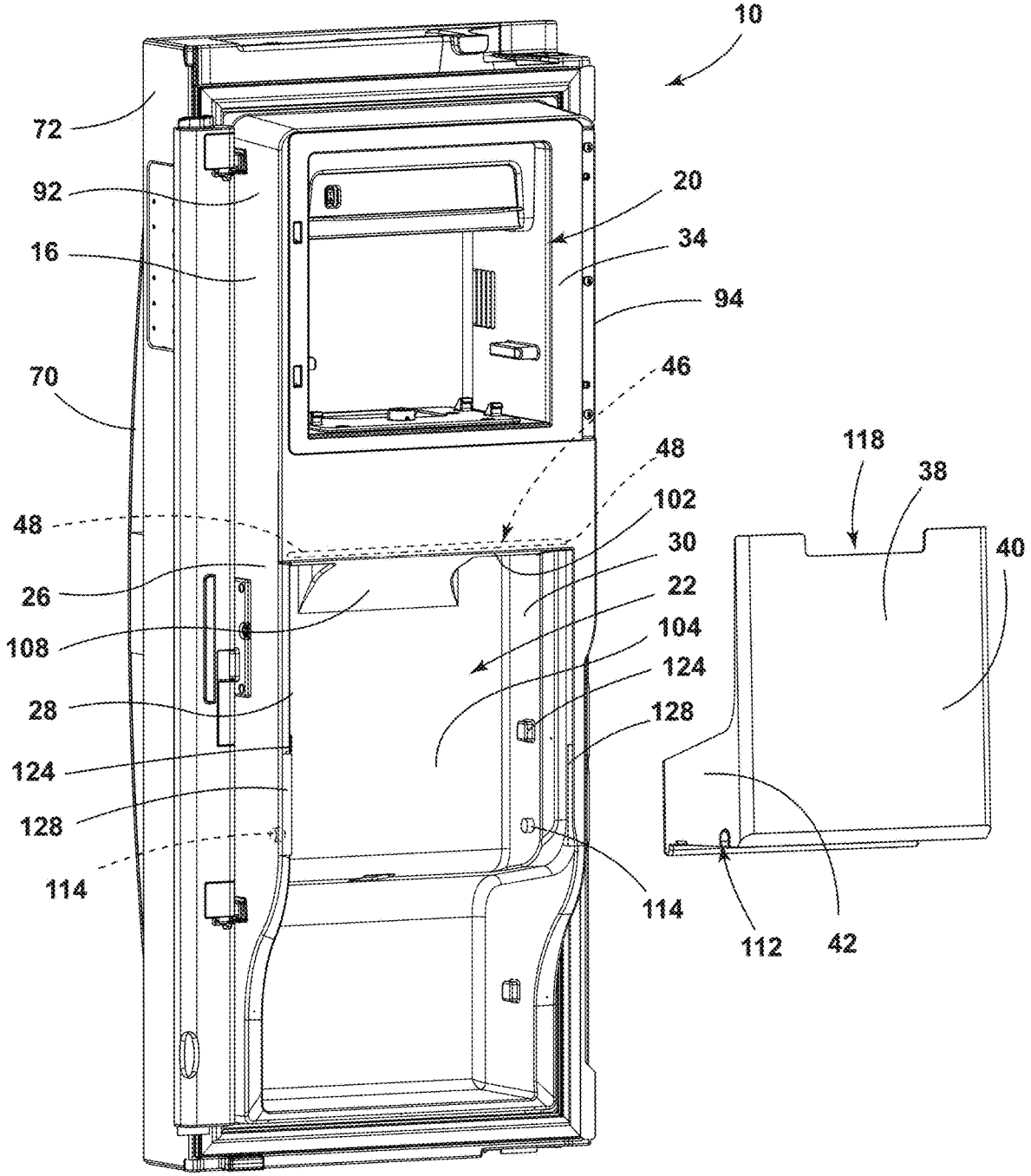
FIG. 5 is a front perspective view of the refrigerator door of FIG. 3 with the bin assembly removed.
Figure 6:
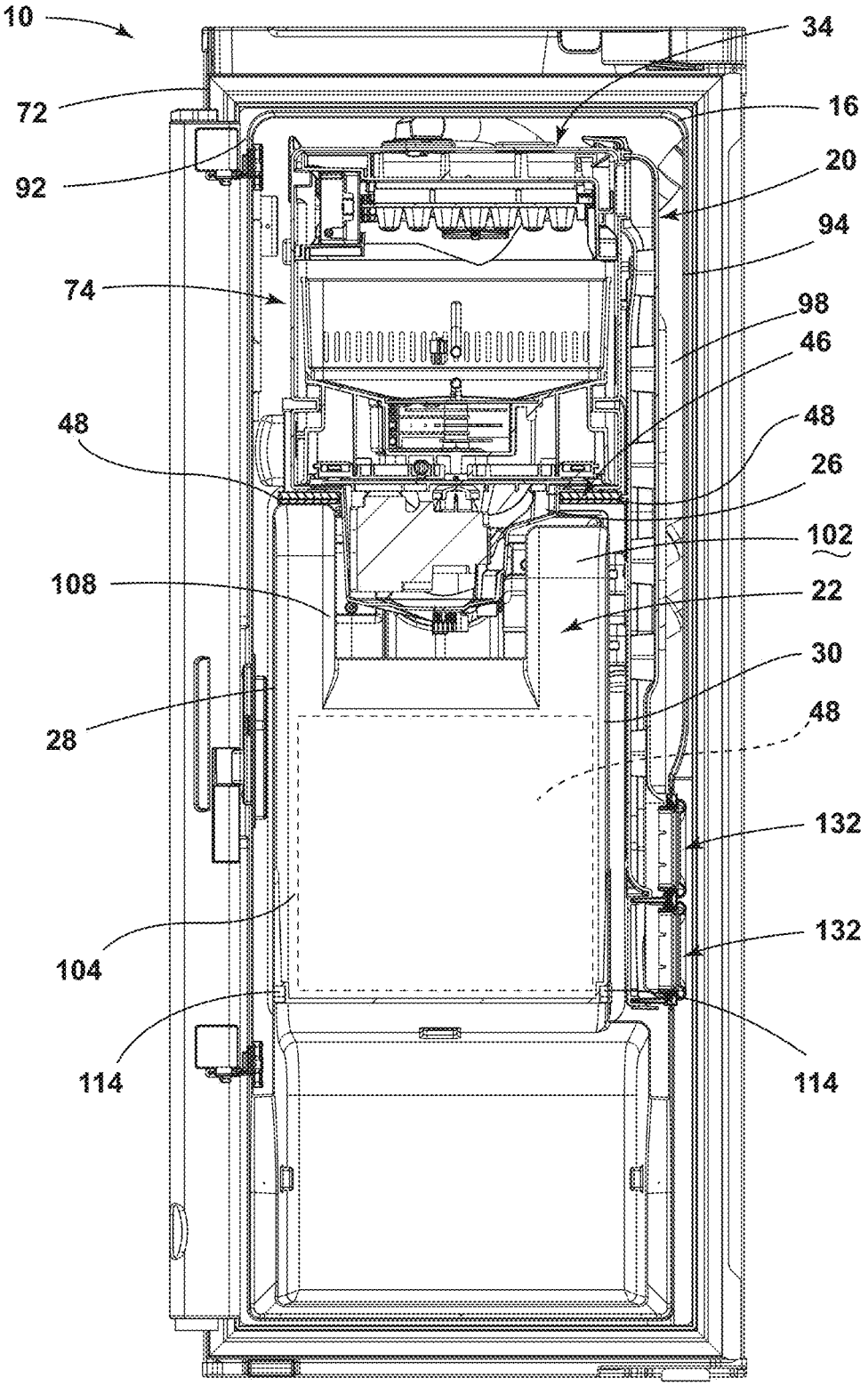
FIG. 6 is a cross-sectional view of the refrigerator door of FIG. 5.
Figure 7:
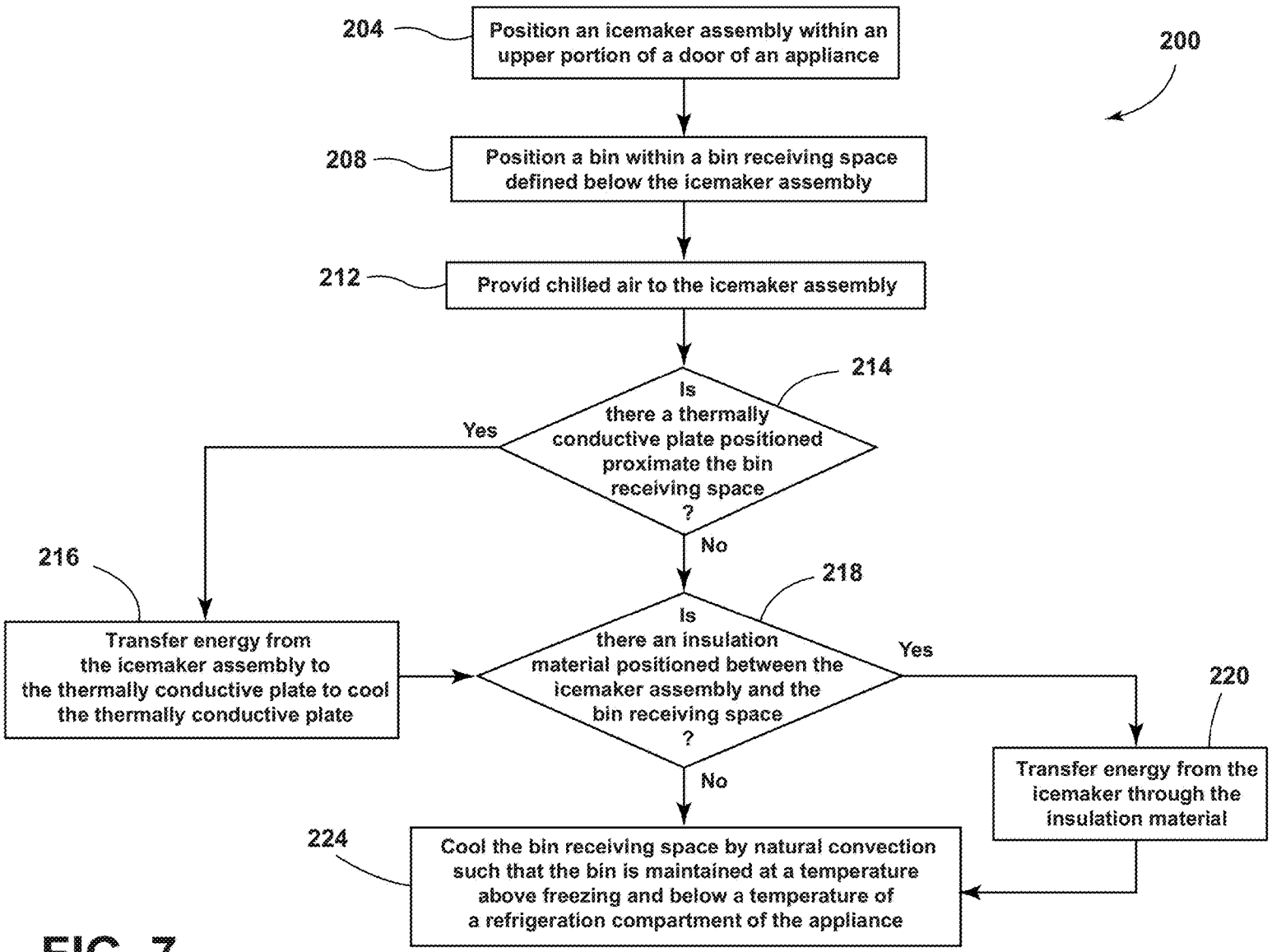
FIG. 7 is a flow diagram of a method of cooling a bin receiving space of the refrigerator doors of FIG. 2, according to various examples.

Referring now to FIGS. 3-6, the refrigerator door 10 including the icemaker assembly 34 is illustrated. The liner 16 includes an outer edge 92 and an inner edge 94. Each edge 92, 94 extends vertically along the refrigerator door 10 and at least partially frames the inner cavity 74 of the refrigerator door 10. As best illustrated in FIG. 6, one or more air ducts 98 may be positioned on the refrigerator door 10. The air ducts 98 are coupled with the inner edge 94 of the liner 16 and are aligned with openings 132 defined by the inner edge 94. However, it is contemplated that the air ducts 98 may be positioned on any portion of the refrigerator door 10, including along the outer edge 92 of the liner 16, without departing from the scope of the present disclosure.

The icemaker assembly 34 is configured to engage with the one or more air ducts 98 positioned on the refrigerator door 10. For example, the one or more air ducts 98 may include a supply duct and a return duct to circulate chilled air to and from the icemaker assembly 34, respectively. The air ducts 98 may be positioned to allow engagement with a portion of the cabinet 60 when the refrigerator door 10 is in a closed position to provide chilled air to/from the air ducts 98 via the openings 132.

As illustrated in FIGS. 3 and 4, the liner 16 of the refrigerator door 10 defines the bin receiving space 22 below the icemaker receiving space 20. A central portion 26 of the liner 16 separates the bin receiving space 22 from the icemaker receiving space 20. The central portion 26 of the liner 16 forms an upper wall 102 at least partially defining the bin receiving space 22 may be at least partially defined by an upper wall 102. The liner 16 further forms opposing sidewalls 28, 30 extending downward from the upper wall 102 to frame the bin receiving space 22. A rear wall 104 is also formed of the liner 16 and extends between the opposing sidewalls 28, 30 and downward from the upper wall 102 of the central portion 26.

In various examples, the upper wall 102 may include a central extension 108 extending downward at least partially into the bin receiving space 22. The central extension 108 may be inclined toward the rear wall 104, may be curved, or may have any other shape without departing from the scope of the present disclosure. It will be understood that the shape of the central extension 108 may be determined by the configuration of the refrigerator door 10. As illustrated in FIG. 6, the central extension 108 may be configured to house components of the icemaker assembly 34.

Referring still to FIGS. 3 and 4, the bin receiving space 22 is configured to receive the bin 38 such that the bin 38 is movable between a closed position (FIG. 3) and an open position (FIG. 4). As illustrated, the bin 38 may be pivotally coupled with the opposing sidewalls 28, 30 of the liner 16. However, it is contemplated that the bin 38 may be slidably, hingedly, or otherwise coupled with the liner 16 without departing from the scope of the present disclosure.

As previously introduced, the bin 38 includes a cover portion 40 integrally formed with a storage portion 42. The cover portion 40 may be generally planar and/or may be rectangular in shape. When the bin 38 is in the closed position, the cover portion 40 is configured to obstruct the bin receiving space 22 and is aligned with outer edges of the sidewalls 28, 30 and the upper wall 102. The cover portion 40 may include a handle 118 configured to allow a user to move the bin 38 between the open and closed positions. As illustrated, the handle 118 may be integrally formed with the cover portion 40 (e.g., the handle 118 may be notch, a receiving space, etc. for a user to grip). Alternatively, the handle 118 may be coupled with the cover portion 40. In some examples, buffers 128 may be positioned on the liner 16 where the cover portion 40 contacts the liner 16.

The storage portion 42 defines receiving wells 112 configured to receive posts 114 to rotatably couple the storage portion 42 with the liner 16. Each receiving well 112 may be defined by one of the opposing side members 116*a*, 116*b* of the storage portion 42. The posts 114 extend laterally from the sidewalls 28, 30 into the bin receiving space 22 and are configured to be received by the receiving wells 112 of the side members 116*a*, 116*b* such that bin 38 is rotatable about the posts 114. The bin 38 is positioned within the bin receiving space 22 such that each of the side members 116*a*, 116*b* of the storage portion 42 is positioned proximate a corresponding sidewall 28, 30. Each of the sidewalls 28, 30 defines a receiving well 112 configured to receive the post 114 or the respective side members 116*a*, 116*b* to rotatably couple the bin 38 with the liner 16. It will be understood that, in various embodiments, the receiving wells 112 may be defined by the sidewalls 28, 30 and the posts 114 may extend from the side members 116*a*, 116*b* of the storage portion 42.

The storage portion 42 further includes a rear member 122 extending between the side members 116*a*, 116*b*. The rear member 122 is positioned opposite the cover portion 40, which also extends between the side members 116*a*, 116*b*. The storage portion 42 defines a storage space 120 having a periphery at least partially defined by the side members 116*a*, 116*b* and the rear member 122. The periphery of the storage space 120 may be further partially defined by the cover portion 40. The storage space 120 is configured to receive beverage containers and may be shaped to act as a cradle for the beverage containers. It is contemplated that, in various examples, the storage portion 42 may be separately formed from the cover portion 40 and may fully define the periphery of the storage space 120. It is further contemplated that, where the cover portion 40 is separately formed from the storage portion 42, the cover portion 40 may be configured as a door 10 operably coupled with the liner 16 and configured to selectively obstruct the bin receiving space 22. For example, the cover portion 40 could be slidably, hingedly, pivotally, or otherwise coupled with the liner 16, and the storage portion 42 could be operably coupled with the liner 16 separately from the cover portion 40.

Referring now to FIGS. 5 and 6, the sidewalls 28, 30 of the liner 16 may include stops 124. Each stop 124 may be integrally formed with the respective sidewalls 28, 30 and extends into the bin receiving space 22. The stops 124 may be configured to guide insertion of the bin 38 and/or to guide movement of the bin 38 within the bin receiving space 22. It will be understood that the liner 16 may alternatively be formed without the stops 124 and/or with other guide members or features.

As previously introduced, the liner 16 and the outer panel 72 define the inner cavity of the refrigerator door 10. The inner cavity 74 may be in communication with a central cavity 46 defined by the central portion 26 of the liner 16. The inner cavity 74 and/or the central cavity 46 may be configured as insulation cavities. For example, the inner cavity 74 and/or the central cavity 46 may include an insulation material (not shown). Insulation material placed in the central cavity 46 defined by the central portion 26 may be configured to maintain the temperature the icemaker assembly 34. For example, the thickness of the insulation material may be configured to fill the central cavity 46 (e.g., the thickness of the insulation material may be substantially equivalent to the height of the cavity 46) or may be configured to only partially fill the central cavity 46 (e.g., the thickness of the insulation material may be less than the height of the cavity 46).

As shown in FIGS. 3-6, the bin receiving space 22 is positioned below the icemaker receiving space 20 and, subsequently, the icemaker assembly 34. The bin receiving space 22 is configured to be maintained at a temperature less than the temperature of the compartment 62 (FIG. 2) but above freezing. The thickness of the insulation material positioned within the central cavity 46 of the central portion 26 is selected to provide cooling of the bin receiving space 22 via natural convection from the icemaker assembly 34 and/or icemaker receiving space 20.

As shown in FIGS. 4-6, one or more plates 48 may be positioned in the central cavity 46 of the central portion 26. The one or more plates 48 may be used in conjunction with the insulation material to provide cooling of the bin receiving space 22 via natural convection. Each of the plates 48 may be configured as a cooling plate 48 formed of a conductive material configured to be cooled by the temperature of the icemaker assembly 34. For example, the plate 48 may be formed of a conductive metal (e.g., copper) configured to be cooled by proximity to the icemaker assembly 34. The plate 48 may be configured to then cool the bin receiving space 22 via the positioning of the plate 48 along the upper wall 102 defining the bin receiving space 22.

As illustrated in FIG. 4, a single plate 48 may be positioned in the central cavity 46 of the central portion 26 and may extend across the upper wall 102 defining the bin receiving space 22. As illustrated in FIGS. 5 and 6, where the upper wall 102 includes the central extension 108, plates 48 may be positioned on either side of the central extension 108 and aligned with the upper wall 102. It will be understood that any number of plates 48 may be used without departing from the scope of the present disclosure. It will further be understood that a plate 48 may be positioned within the central extension 108, depending on the configuration of the refrigerator door 10 and the liner 16. Further, as shown in FIG. 6, in various examples, one of the one or more plates 48 may be positioned proximate the rear wall 104 defining the bin receiving space 22. Alternatively, it is contemplated that one or more plates 48 may be positioned proximate the sidewalls 28, 30 defining the bin receiving space 22. For example, a plate 48 may be positioned between the air ducts 98 and one of the sidewalls 28, 30.

Referring now to FIGS. 1-7, a method 200 of cooling a bin 38 and/or a bin receiving space 22 coupled with a door 10 of an appliance 12 includes a step 204 of positioning an icemaker assembly 34 within an upper portion of the door 10. An icemaker receiving space 20 may be defined by a liner 16 proximate the upper portion of the door 10 and configured to receive the icemaker assembly 34.

The method 200 may further include a step 208 of positioning the bin 38 within a bin receiving space 22 defined by the liner 16 of the door 10. The bin receiving space 22 may also be separated from the icemaker assembly 34 and/or the icemaker receiving space 20 by a central portion 26 of the liner 16. A central cavity 46 may be defined by the central portion 26 of the liner 16 between the bin receiving space 22 and the icemaker receiving space 20 and/or icemaker assembly 34. The bin 38 may be formed to include a cover portion 40 and a storage portion 42. The storage portion 42 may be configured during manufacture to define a storage space 120 to receive and house beverage containers.

Another step 212 includes providing chilled air to the icemaker assembly 34 to maintain at least a portion of the icemaker assembly 34 at a temperature at or below freezing. This further may maintain at least a portion of the icemaker receiving space 20 at a temperature at or below freezing. The chilled air may be provided via air ducts 98 coupled with the icemaker receiving space 20 and/or the icemaker assembly 34.

The method 200 further includes a step 224 of cooling the bin receiving space 22 by natural convection such that the bin 38 is maintained at a temperature above freezing and below a temperature of a refrigeration compartment 62 of the appliance 12. For example, the natural convection may be configured to maintain the bin receiving space at a temperature between 3° F. and 5° F. cooler than the refrigeration compartment 62 (e.g., between 32° F. and 45° F. or at about 34° F.). The natural convection provides movement of warm air upward and cool air downward and into the bin receiving space 22 to cool the bin receiving space 22 and/or bin 38. The cooling of the bin receiving space 22 may occur through the central portion 26 of the liner 16.

In various examples, a thermally conductive plate 48 may be positioned proximate the bin receiving space 22. The method 200 may include a decision step 214 to determine if a plate 48 is positioned proximate the bin receiving space 22. When the plate 48 is positioned proximate the bin receiving space 22, the method 200 includes a step 216 of transferring thermal energy from the icemaker assembly 34 and/or the icemaker receiving space 20 to the plate 48 to cool the plate 48. Cooling the plate 48 may be configured to result in the cooling of the bin receiving space 22 by natural convection. In other examples, an insulation material may be positioned between the icemaker assembly 34 and/or the icemaker receiving space 20 and the bin receiving space 22. The method 200 may include a decision step 218 to determine if insulation material may be positioned between the icemaker assembly 34 and/or the icemaker receiving space 20 and the bin receiving space 22. When insulation material is positioned between the icemaker assembly 34 and/or the icemaker receiving space 20, the method 200 includes a step 220 of transferring energy from the icemaker assembly 34 and/or the icemaker receiving space 20 through the insulation material. A thickness of the insulation material is selected to result in, or allow, the cooling of the bin receiving space 22 by natural convection.

According to one aspect, an appliance door for a refrigerator appliance includes a liner that defines an icemaker receiving space and a bin receiving space. The icemaker receiving space is at least partially defined by a central portion of the liner, and the bin receiving space is at least partially defined by the central portion and opposing sidewalls of the liner. An icemaker assembly is positioned within the icemaker receiving space and above the central portion. A bin is positioned in the bin receiving space and below the central portion. The bin includes a cover portion that extends upward from a storage portion. The storage portion is rotatably coupled with the opposing sidewalls of the liner. A plate is positioned within a central cavity defined by the central portion of the liner. The plate is configured to cool the bin receiving space.

According to another aspect, a central portion of a liner of an appliance door includes an upper wall that defines a bin receiving space, and a plate that extends at least partially along the upper wall.

According to still another aspect, an appliance door includes an upper wall that includes a central extension that extends downward at least partially into a bin receiving space.

According to another aspect, an appliance door includes insulation material positioned within a central cavity proximate a plate.

According to another aspect, opposing sidewalls of a liner of an appliance door include laterally extending posts that extend into a bin receiving space, and a storage portion of a bin defines receiving wells. The laterally extending posts are configured to be received by the receiving wells such that the bin is rotatable about the laterally extending posts.

According to another aspect, a storage portion defines a storage space for receiving goods to be stored at a temperature above freezing and below a temperature of a refrigerated compartment.

According to yet another aspect, an appliance door includes a duct coupled with an icemaker assembly and configured to provide chilled air to the icemaker assembly.

According to still another aspect of the present disclosure, a plate is positioned between a bin and a duct in an appliance door.

According to another aspect, a refrigerator appliance includes a cabinet that defines a compartment. A door is hingedly coupled with the cabinet and configured to selectively seal the cabinet. The door includes a liner and an icemaker assembly. A duct is coupled with the icemaker assembly and is configured to provide chilled air to the icemaker assembly. A bin is positioned below the icemaker assembly. The bin is configured to maintain a temperature below the temperature of the compartment and above freezing.

According to another aspect, a liner of a refrigerator appliance is coupled with an outer panel of a door to define an inner cavity.

According to yet another aspect, a refrigerator appliance includes a plate positioned within an inner cavity and aligned with a rear wall of a liner proximate a bin.

According to another aspect, a refrigerator appliance includes a plate positioned between a bin and a duct.

According to another aspect, a bin of a refrigerator appliance includes a cover portion and a storage portion that defines a storage space for receiving beverage containers.

According to another aspect, a storage portion of a bin is rotatably coupled with a liner of a refrigerator appliance.

According to another aspect, a cover portion of a bin is rotatably coupled with a liner of a refrigerator appliance.

According to another aspect, a cover portion a bin of a refrigerator appliance is integrally formed with a storage portion of the bin.

According to another aspect, a liner of a refrigerator appliance includes a central portion that extends between an icemaker assembly and a bin and that defines a central cavity.

According to another aspect, a refrigerator appliance includes a plate positioned within a central cavity and formed of a conductive material.

According to another aspect, a refrigerator appliance includes insulation material positioned within a central cavity.

According to another aspect, a method of cooling a bin coupled with an appliance door includes a step where an icemaker assembly is positioned within an upper portion of the appliance door. Next, the bin is positioned within a bin receiving space defined by a liner of the appliance door and separated from the icemaker assembly by a central portion of the liner. Chilled air is provided to the icemaker assembly to maintain at least a portion of the icemaker assembly at a temperature below freezing. The bin receiving space is cooled by natural convection through the central portion of the liner between the icemaker assembly and the bin receiving space such that the bin is maintained at a temperature above freezing and below a temperature of a refrigeration compartment of the appliance.

According to another aspect, a method of cooling a bin coupled with an appliance door includes a step where a plate formed of a thermally conductive material is cooled. Energy is then transferred from an icemaker assembly to the plate and results in the cooling of a bin receiving space by natural convection.

According to another aspect, a method of cooling a bin coupled with an appliance door includes a step where energy from an icemaker assembly is transferred through an insulation material. A thickness of the insulation material results in the cooling of a bin receiving space by natural convection.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance door for a refrigerator appliance, comprising:

a liner defining an icemaker receiving space and a bin receiving space, wherein the icemaker receiving space is at least partially defined by a central portion of the liner and the bin receiving space is at least partially defined by the central portion and opposing sidewalls of the liner;

an icemaker assembly positioned within the icemaker receiving space and above the central portion;

a bin positioned in the bin receiving space and below the central portion, the bin including a cover portion extending upward from a storage portion, wherein the storage portion is rotatably coupled with the opposing sidewalls of the liner; and a plate positioned within a central cavity defined by the central portion of the liner, wherein the plate is configured to cool the bin receiving space.

2. The appliance door of claim 1, wherein the central portion of the liner includes an upper wall defining the bin receiving space and the plate extends at least partially along the upper wall.

3. The appliance door of claim 2, wherein the upper wall includes a central extension extending downward at least partially into the bin receiving space.

4. The appliance door of claim 1, wherein the opposing sidewalls of the liner include laterally extending posts extending into the bin receiving space and the storage portion of the bin defines receiving wells, the laterally extending posts configured to be received by the receiving wells such that the bin is rotatable about the laterally extending posts.

5. The appliance door of claim 1, further comprising:

insulation material positioned within the central cavity proximate the plate.

6. The appliance door of claim 1, further comprising:

a duct coupled with the icemaker assembly and configured to provide chilled air to the icemaker assembly.

7. The appliance door of claim 6, wherein the plate is positioned between the bin and the duct.

8. The refrigerator appliance of claim 1, further comprising:

insulation material positioned within the central cavity.

9. A method of cooling a bin coupled with an appliance door, comprising steps of:

positioning an icemaker assembly within an upper portion of said appliance door;

positioning said bin within a bin receiving space defined by a liner of said appliance door and separated from the icemaker assembly by a central portion of the liner;

providing chilled air to the icemaker assembly to maintain at least a portion of the icemaker assembly at a temperature below freezing; and cooling the bin receiving space by natural convection through the central portion of the liner between the icemaker assembly and the bin receiving space such that said bin is maintained at a temperature above freezing and below a temperature of a refrigeration compartment of said appliance door.

10. A refrigerator appliance comprising:

a cabinet defining a compartment;

a door hingedly coupled with the cabinet and configured to selectively seal the cabinet, wherein the door includes a liner and an icemaker assembly, wherein the liner includes a central portion extending between the icemaker assembly and the bin, the central portion defining a central cavity;

a duct coupled with the icemaker assembly and configured to provide chilled air to the icemaker assembly;

a bin positioned below the icemaker assembly, wherein the bin is configured to maintain a temperature below the temperature of the compartment and above freezing.

11. The refrigerator appliance of claim 10, wherein the liner is coupled with an outer panel of the door to define an inner cavity.

12. The refrigerator appliance of claim 11, further comprising:

a plate positioned within the inner cavity and aligned with a rear wall of the liner proximate the bin.

13. The refrigerator appliance of claim 10, wherein the bin includes a cover portion and a storage portion defining a storage space for receiving beverage containers.

14. The refrigerator appliance of claim 13, wherein the storage portion is rotatably coupled with the liner.

15. The refrigerator appliance of claim 12, wherein the plate is positioned between the bin and the duct.

16. The refrigerator appliance of claim 13, wherein the cover portion is rotatably coupled with the liner.

17. The refrigerator appliance of claim 13, wherein the cover portion is integrally formed with the storage portion.

18. The refrigerator appliance of claim 1, further comprising:

a plate positioned within the central cavity, the plate formed of a conductive material.

19. The method of claim 9, further comprising steps of:

cooling a plate formed of a thermally conductive material; and transferring energy from the icemaker assembly to the plate resulting in cooling of the bin receiving space by natural convection.

* * * * *